US008353385B1

(12) United States Patent
SanCartier

(10) Patent No.: US 8,353,385 B1
(45) Date of Patent: Jan. 15, 2013

(54) DECORATIVE END-CAP FOR MOTOR VEHICLE EXHAUST SYSTEM

(75) Inventor: Joseph Darcy SanCartier, Hugo, MN (US)

(73) Assignee: Custom Color Caps, Inc., Hugo, MN (US)

( * ) Notice: Subject to any disclaimer, the term of this patent is extended or adjusted under 35 U.S.C. 154(b) by 0 days.

(21) Appl. No.: 13/191,350

(22) Filed: Jul. 26, 2011

Related U.S. Application Data

(60) Provisional application No. 61/400,311, filed on Jul. 26, 2010.

(51) Int. Cl.
*F01N 13/08* (2010.01)

(52) U.S. Cl. ..... 181/228; 181/227

(58) Field of Classification Search ..... 181/227, 181/228

See application file for complete search history.

(56) References Cited

U.S. PATENT DOCUMENTS

| | | | | |
|---|---|---|---|---|
| D468,673 | S * | 1/2003 | Horowitz | D12/194 |
| D513,397 | S | 1/2006 | Lovato et al. | |
| 7,007,720 | B1 | 3/2006 | Chase et al. | |
| 7,464,787 | B2 * | 12/2008 | Davis, Jr. | 181/227 |
| 2005/0167191 | A1 * | 8/2005 | Miller | 181/227 |

* cited by examiner

*Primary Examiner* — Jeremy Luks
(74) *Attorney, Agent, or Firm* — Schwegman Lundberg & Woessner, P.A.

(57) ABSTRACT

An exhaust pipe end-cap that includes an annulus having an annular leading edge and an annular trailing edge, an annular interior surface having a frusto-conical shape for mating with an exterior frusto-conical shape of an exterior surface of an exhaust system, an outer surface on said annulus for carrying a decorative design thereon, and a fastener located on the annular interior surface for securing the exhaust end-cap to the exterior surface of the exhaust system.

11 Claims, 12 Drawing Sheets

DECORATIVE END-CAP FOR MOTOR VEHICLE EXHAUST SYSTEM

CROSS-REFERENCE TO RELATED APPLICATIONS

This application claims the benefit of U.S. Provisional Application No. 61/400,311, filed on Jul. 26, 2010, entitled, "Decorative End-cap for Motor Vehicle Exhaust System," under 35 U.S.C. §119(e), which is incorporated herein by reference in its entirety.

TECHNICAL FIELD

The present document relates generally to end-caps and, more specifically, to exhaust system end-caps for motor vehicles.

BACKGROUND

Engines include exhaust systems for exhausting gas to the atmosphere. The exhaust system may include a manifold connected to the engine, exhaust piping, a muffler, a tailpipe, and a decorative end-cap mounted to an exit. Decorative end-caps have been used on exhaust systems to provide an aesthetic accent to a vehicle. Unfortunately, such exhaust caps are difficult to install. What is needed is an alternative that is inexpensive and easy to install.

SUMMARY

Various examples include a decorative motor vehicle end-cap or sleeve having an interior surface for mating with and attaching to an exterior surface of a motor vehicle exhaust system such as a muffler or tail pipe of a motorcycle, car or truck. In various examples, at least a portion of an outer surface of the motor vehicle end-cap includes a decorative design.

This summary is intended to provide an overview of subject matter of the present patent application. It is not intended to provide an exclusive or exhaustive explanation of the invention. The detailed description is included to provide further information about the present patent application.

BRIEF DESCRIPTION OF THE DRAWINGS

In the drawings, which are not necessarily drawn to scale, like numerals may describe similar components in different views. Like numerals having different letter suffixes may represent different instances of similar components. The drawings illustrate generally, by way of example, but not by way of limitation, various embodiments discussed in the present document.

DETAILED DESCRIPTION

Figure 1:
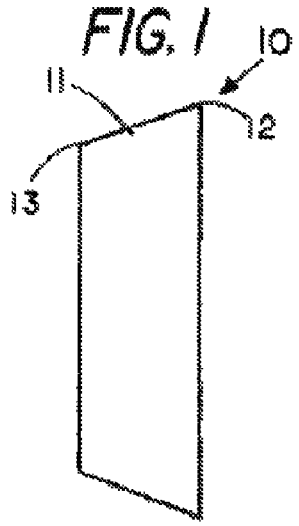
FIG. 1 is a right side view of a motor vehicle end-cap usable as an exhaust system end-cap, according to some examples.
Figure 2:
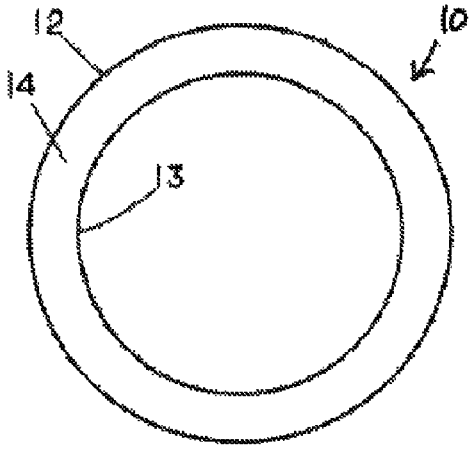
FIG. 2 is a front view of the end-cap of FIG. 1.
Figure 3:
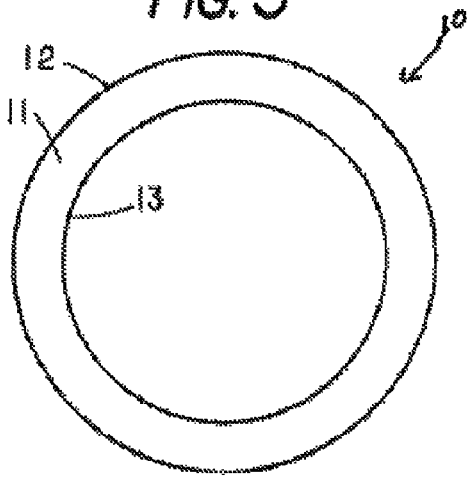
FIG. 3 is a back view of the end-cap of FIG. 1.

FIG. 1 shows a right side view of an end-cap 10 usable as a decorative end-cap for a motor vehicle exhaust system, according to some examples. FIG. 2 shows a front view of the end-cap and FIG. 3 show a back view of the end-cap. Exhaust systems contemplated include, but are not limited to, unbaffled pipes, mufflers, slip-ons, resonators and other systems. In some examples, end-cap 10 is used as an exhaust system end-cap for a motorcycle exhaust system. In various examples, end-cap 10 is used on an exhaust system for an over-the-road truck. In some motorcycle examples, end-cap 10 is applied to an exhaust system such as that fitted on a Harley Davidson® motorcycle.

End-cap 10, in some examples, is sized to define and interior shaped to receive a specific exhaust system. For example, end-cap 10 is sized to mate snuggly to an exhaust system, with an interior surface 14 disposed against an exterior of an exhaust system. In some examples, the surface 14 faces and abuts and exterior of an exhaust system.

End-cap 10 comprises an annulus or sleeve having a frusto-conical outer surface 11 for carrying a decorative pattern thereon, according to some examples. In some examples, the decorative pattern is located in the outer surface 11, such as via etching or engraving. In some examples, the decorative pattern extends between an annular leading edge 12 and an annular trailing edge 13. Although the leading edge and trailing edge are parallel in the figure, the present subject matter is not so limited and extends to embodiments in which they are skew. Certain examples include edges which are nonplanar.

In various examples, the end-cap 10 is metallic. Examples include, but are not limited to, an aluminum end-cap, a steel end-cap, a copper end-cap, and alloys thereof. In some examples, the end-cap is formed of a resin based composite, including, but not limited to, molded composites and laminates. In certain examples, the exhaust system is formed materials including, but not limited to, steel, stainless steel, titanium and their alloys.

In some examples, located on the interior of exhaust system end-cap 10 is a frusto-conical shaped surface 14 for mating to an exterior surface of an exhaust system such as a motorcycle exhaust system. The interior surface of the motorcycle exhaust system end-cap is shaped to conform to an exterior surface of the motorcycle exhaust system. Various examples form a snug fit with an exterior surface of the motorcycle exhaust system. Various examples enable one to axially slide the exhaust system end-cap onto the end portion of motorcycle exhaust system. In some examples, hand-tools are not required install an end-cap to an exhaust system.

Figure 4:
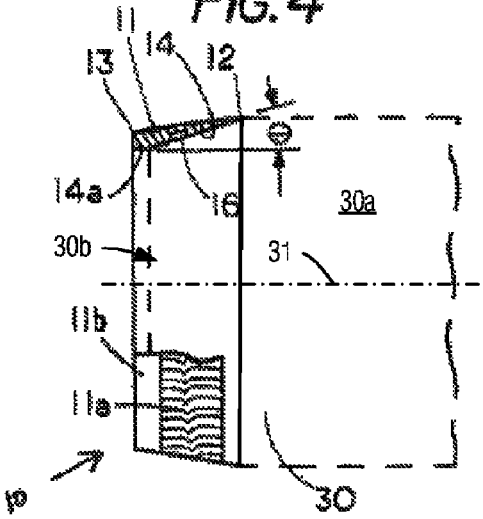
FIG. 4 is a partial sectional view showing an end-cap mounted on an end portion of an exhaust system, according to some examples.

FIG. 4 is a partial sectional view showing an end-cap mounted on an end portion of an exhaust system, according to some examples. In some examples tubing of an exhaust system concentrically convergences at the end portion of the exhaust system toward an axis 31. Such convergence is indicated by the angle Θ. An annulus 10 comprising the exhaust system end-cap 10 includes an inner frusto-conical shaped surface 14 that mates with the exterior surface 30*a* of exhaust system 30 to form a snug fit therebetween. In various examples, the end-cap 10 is axially positioned on the terminal end portion of exhaust system 30. In some examples, the snug fit reduces or prevents instances of lateral movement of the exhaust system end-cap. In some examples, the taper fit reduces or prevents instances of the exhaust system end-cap from sliding forward on the exhaust system.

In various examples, the exhaust system end-cap includes an annular axially extending lip 14*a* that extends outward past the end portion 30*b* of exhaust system 30. In some examples, this is because the annular lip is configured so as not to mate with the exterior surface of exhaust system 30. In some examples, the trailing edge of the exhaust system end-cap is coextensive with the end portion of the exhaust system. In some examples, the use of a lip that extends beyond the end portion of the exhaust system accommodates differences in the end surface of the exhaust system by to hide them from view so they do not appear as a distraction to the design. Although the exhaust system end-cap is shown on the terminal end portion of the exhaust system in some examples, in additional examples the annulus forming the exhaust system end-cap is positioned around the exhaust system and spaced from the terminal end portion of are exhaust system.

In some examples the end-cap is used with exhaust systems wherein the outlet does not converge. In these instances a tip on the end-cap is used to reduce or prevent instances in which the end-cap slides forward. In some examples, the snug fit between the interior surface of the end-cap and the exterior surface of the exhaust system reduces or prevents instances of lateral movement of the end-cap.

In some examples, an internal fastener is located between the end-cap and the exhaust system to fix the end-cap to the exhaust system. In some examples, the surface 14 abuts an exhaust system but for a fastener such as an adhesive covering a part of the surface 14. In some examples, the fastener includes an adhesive includes silicone. In some examples, the fastener includes an adhesive including high-temperature silicone. In some examples, the fastener has a higher coefficient of thermal expansion than each of the exhaust system and the sleeve. In some examples, the sleeve is metallic and has a different coefficient of thermal expansion than the exhaust system, which is also metallic.

FIG. 4 shows the exterior surface 11 of exhaust system end-cap 10 includes a first outer annular surface 11*b* which is undecorated and a second annular surface 11*a* which contains a decorative design 11*a*. The decorative design 11*a* is a band of color, in some examples. Some examples include a message or another feature to provide a decorative appearance to the end-cap 10. In some examples, the decorative design is formed of a powder coating. In some examples, the decorative design extends over only a portion of the sleeve.

In various examples, a distance between the leading edge 12 and the trailing edge 13 is selected to extend are trailing edge away from a distal exhaust exit portion 30*b* in use, with an exposed portion of the annular interior surface extending between the trailing edge and the exhaust exit portion. As such, in some examples the end-cap overhangs the exhaust system such that both the interior surface and the outer surface of the end-cap are exposed along the overhang.

Figure 5:
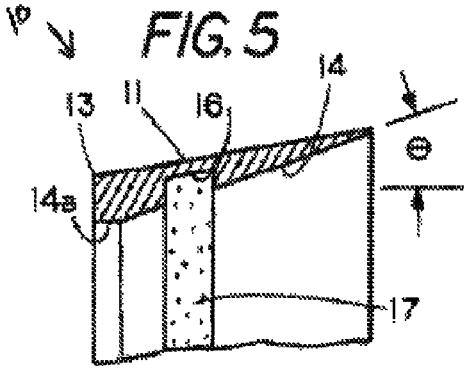
FIG. 5 shows a sectional view of a portion of the end-cap of FIG. 4.

FIG. 5 shows a cross sectional view of the exhaust system end-cap without the exhaust system therein to reveal the exhaust system end-cap having an angle Θ which corresponds to the angle Θ of the terminal end portion of exhaust system 30 so that when the exhaust system end-cap 10 is axially positioned on exhaust system 30 it forms a snug fit therebetween. In some examples, the angle of the exhaust system sleeve is substantially the same angle as the angle of the terminal end of the exhaust system. An annular recess 16 located on the interior of exhaust system end-cap 10 includes a fastener comprising an adhesive 17 which is used to secure the exhaust system end-cap to the exhaust system, in some examples. In some examples, a thickness of a leading edge of the exhaust system sleeve is less than a thickness of the trailing edge of the exhaust system sleeve.

Figure 6:
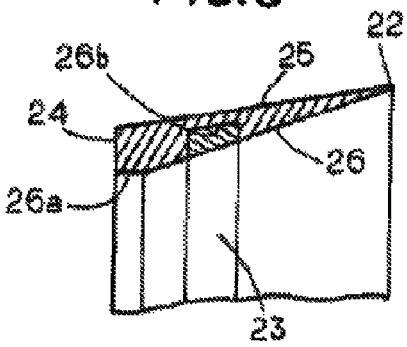
FIG. 6 shows a sectional view of a portion of a motor vehicle exhaust system end-cap including a magnet, according to some examples.

FIG. 6 shows an alternate embodiment wherein the fastener includes magnetic material such as a magnetic strip 23 that is secured to the interior surface 26*b* of exhaust system end-cap. In some examples the magnetic strips hold the exhaust system end-cap in position on the end portion of the exhaust system, which allows a user to quickly change the exhaust system end-cap. In some examples, a fastener such as an adhesive or the like is used. In some examples, the magnetic strip 26*b* is substantially flush with the interior surface 26. In some examples, a cross section of the magnetic strip is substantially trapezoidal. Some examples adhere the magnetic strip into the recess.

Figure 7:
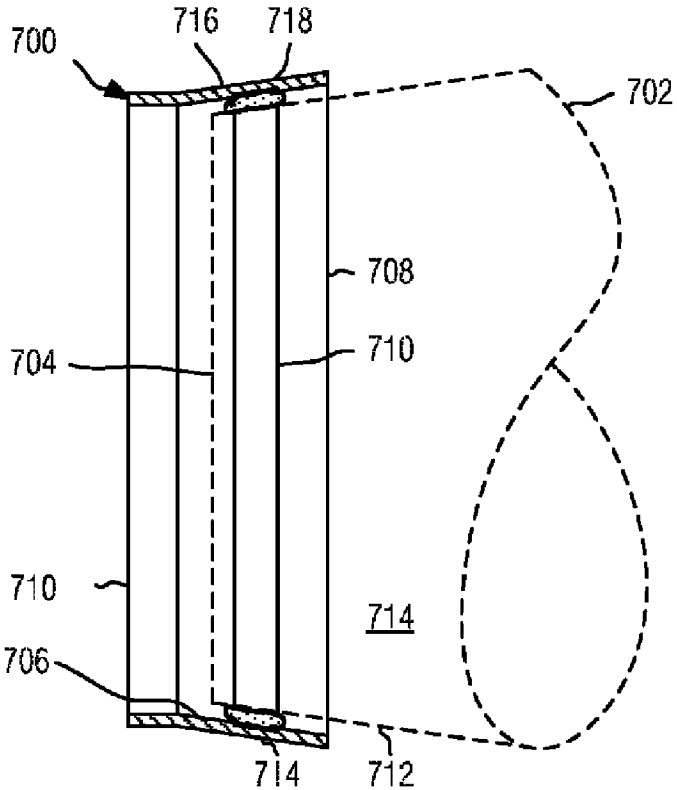
FIG. 7 shows a short motor vehicle exhaust system end-cap, with the end-cap protruding away from the exhaust system, according to some examples.

FIG. 7 shows a motor vehicle exhaust system end-cap according to some examples. Various examples include end-cap or sleeve 700 mountable to an exhaust system having a distal exhaust exit portion 702 having a frusto-conical shape. In various examples, the sleeve defines an interior surface 706 that substantially conforms to the exhaust exit portion 702. In some cases the interior surface 706 has a generatrix that is substantially parallel to a generatrix of the exit portion 702, but the present subject matter is not so limited. In some examples, a pliable adhesive is disposed between the exit portion 702 and the sleeve 700 to permit a generatrix that is not substantially parallel to a generatrix of the exit portion 702. In some of these, the sleeve is out of direct contact with the exit portion 702.

In some examples, the elongate sleeve includes an annular leading edge 708 defining a leading opening, and an annular trailing edge 710 defining a trailing opening. In various examples, the trailing opening is of a smaller diameter than the leading opening, but the present subject matter is not so limited. In various examples, the leading opening is in fluid communication with the trailing opening, such as to permit gas flow.

Various examples include an annular interior surface 706 having a frusto-conical shape extending between the leading edge 708 and the trailing edge 710. In various examples, the sleeve 700 defines an annular recess 718 in the annular interior surface, the annular recess extending around the sleeve 700 along a plane perpendicular to the view that is substantially parallel with the leading opening 708. In some examples, the annular interior surface 706 is configured to mate with an exterior frusto-conical shape 712 of an exterior surface of an exhaust system. Various examples include an outer surface, e.g., 1002 pictured in FIG. 12, with a decorative design other than an appearance of the distal exit exhaust portion 712. Decorative designs are formed of etchings, carvings, paintings, coatings, decals and are formed with other systems or methods.

In various examples, the sleeve 702 is sized to dispose the annular recess along the exterior surface 714 of the exhaust system 712 in use. Various examples include a flexible polymeric adhesive 716 disposed in the annular recess to affix the sleeve 700 to the exterior surface 714 of the exhaust system 702.

Figure 8:
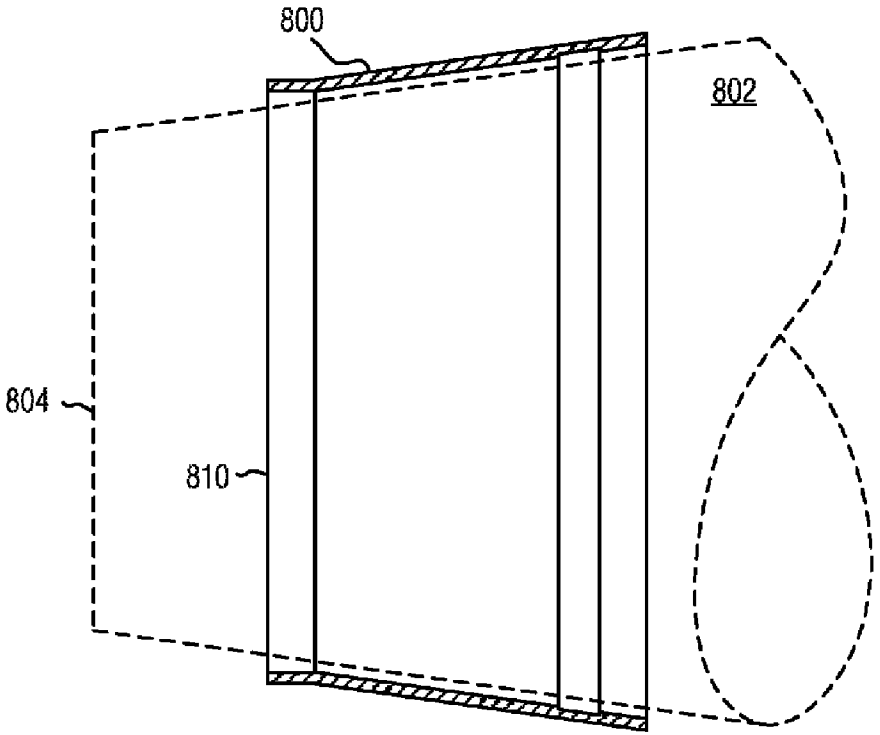
FIG. 8 shows a motor vehicle exhaust system end-cap mounted to an exhaust system, with the exhaust system protruding, according to some examples.

FIG. 8 shows a motor vehicle exhaust system end-cap according to some examples. In the example, an exit portion 804 of the exterior surface 802 of an exhaust extends beyond a trailing edge 810 of an end-cap.

Figure 9:
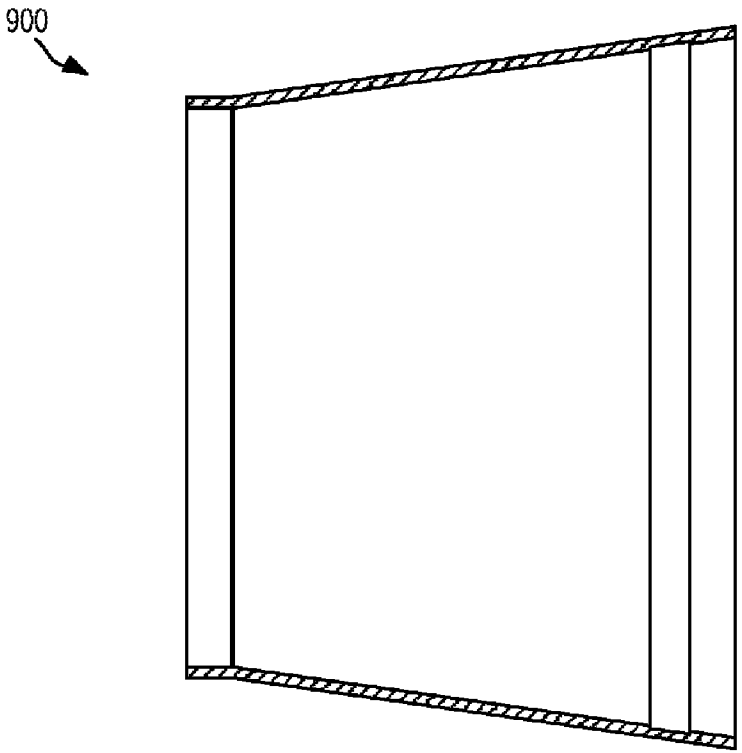
FIG. 9 shows a cross-section of motor vehicle exhaust system end-cap that is longer than either of the end-caps of FIGS. 7-8, according to some examples.

FIG. 9 shows a motor vehicle exhaust system end-cap according to some examples. The end-cap system 900 is approximately 3.75 inches in length, but other lengths are possible, including, but not limited to, 1 inch, 4 inches and other lengths.

Figure 10:
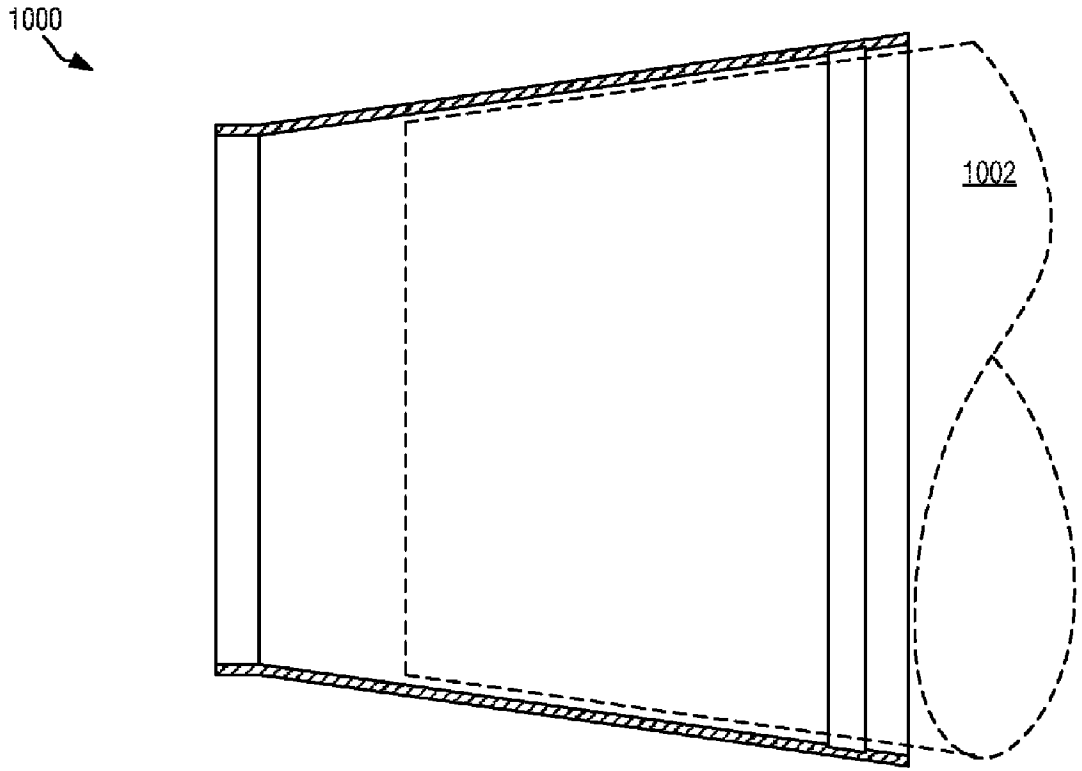
FIG. 10 shows an example of a motor vehicle exhaust system end-cap that is longer than the end-cap of FIGS. 7-9, according to some examples.
Figure 11:
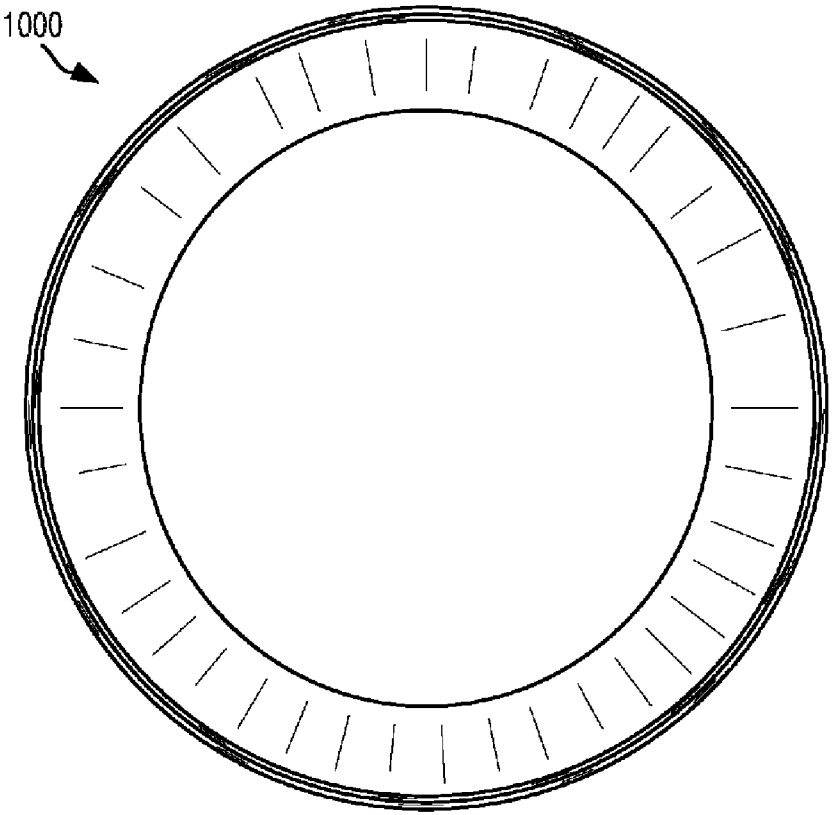
FIG. 11 is a front view of the end-cap of FIG. 10.
Figure 12:
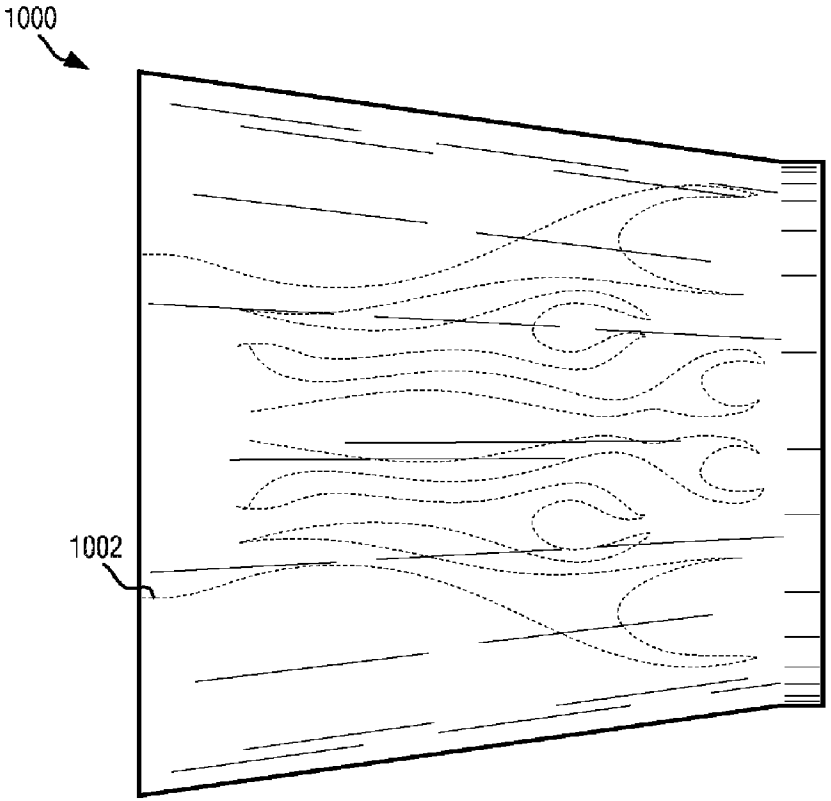
FIG. 12 is a right side view of an end-cap of FIG. 10.
Figure 13:
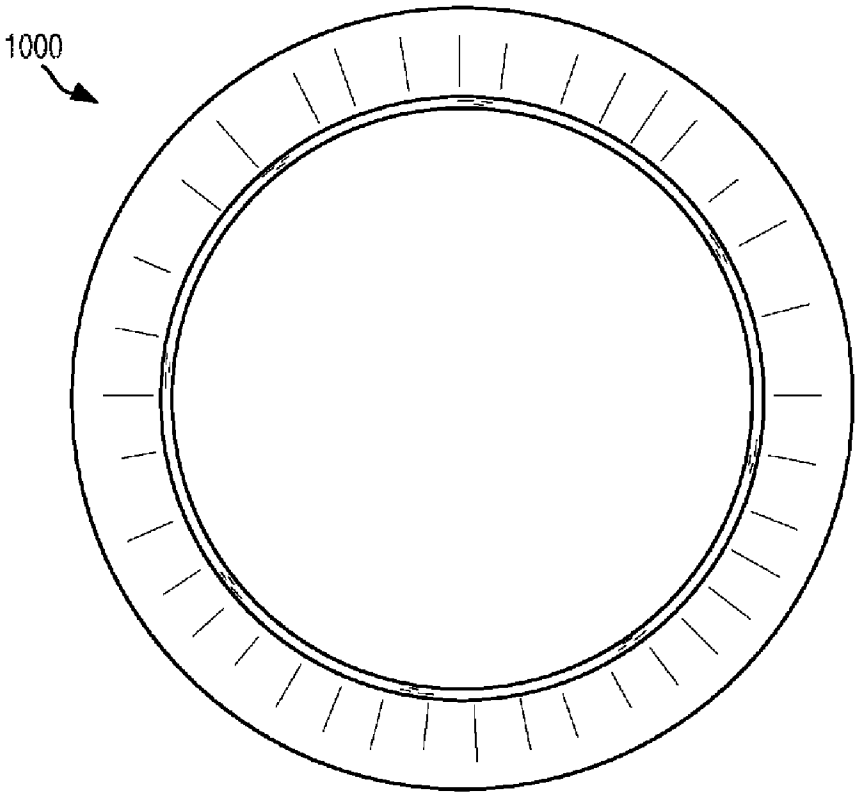
FIG. 13 is a back view of an end-cap of FIG. 10.
Figure 14:
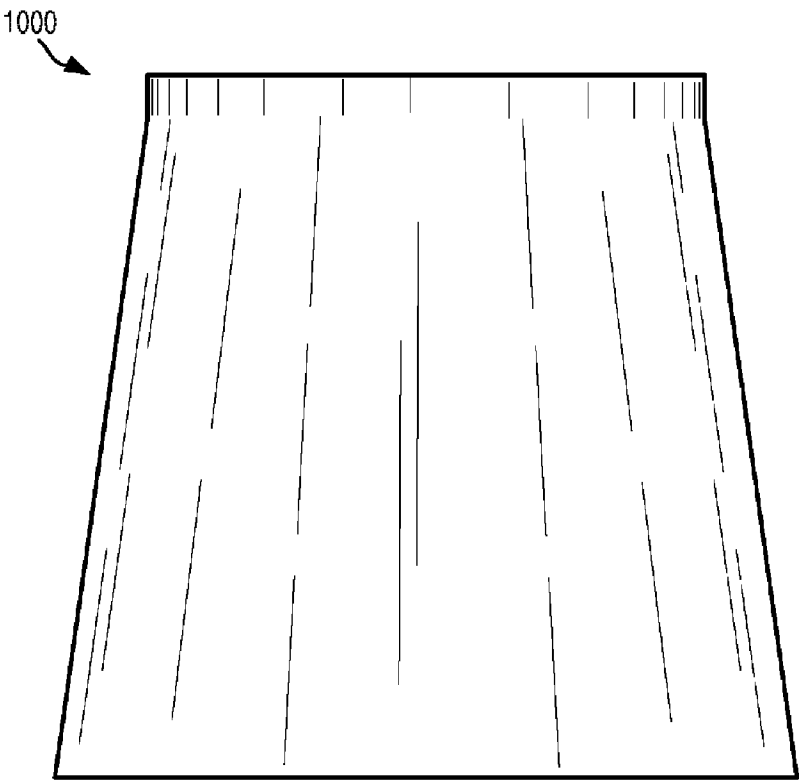
FIG. 14 is a top view of an end-cap of FIG. 10.
Figure 15:
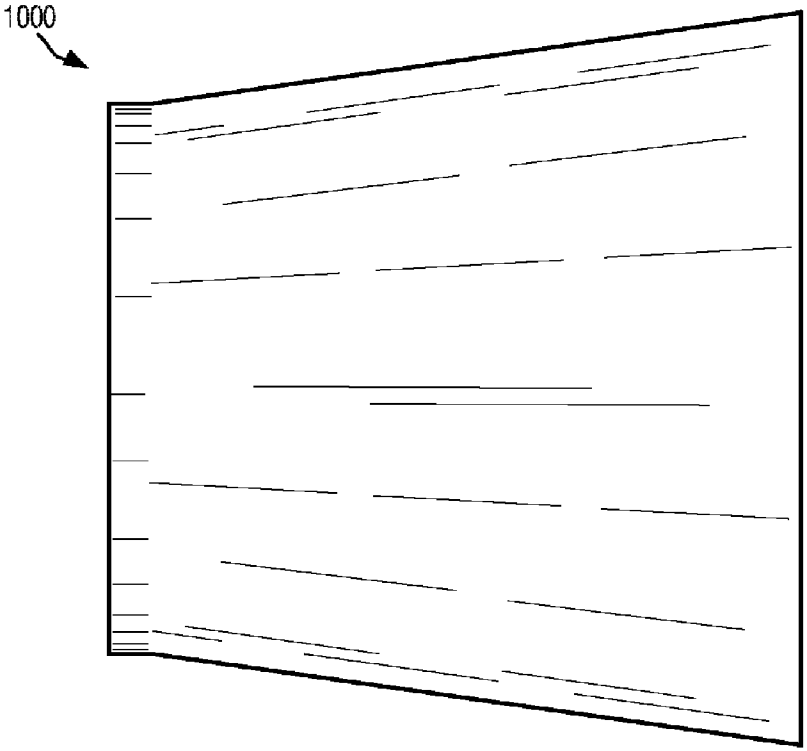
FIG. 15 is a left side view of an end-cap of FIG. 10.
Figure 16:
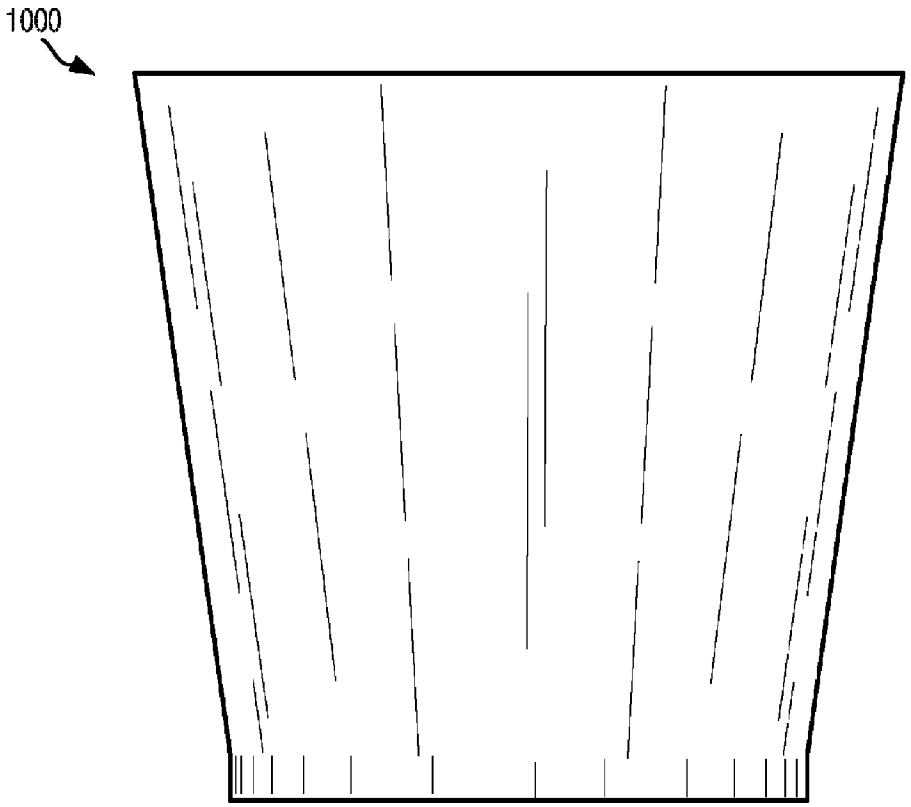
FIG. 16 is a bottom view of an end-cap of FIG. 10.

FIG. 10 shows a cross-section of a motor vehicle exhaust system end-cap of FIG. 10. FIG. 11 is a front view of the end-cap of FIG. 10. FIG. 12 is a right side view of an end-cap of FIG. 10. FIG. 13 is a back view of an end-cap of FIG. 10. FIG. 14 is a top view of an end-cap of FIG. 10. FIG. 15 is a left side view of an end-cap of FIG. 10. FIG. 16 is a bottom view of an end-cap of FIG. 10. FIG. 12 shows an example of a decorative design, according to some examples. The decorative design is formed using paint, etching, carvings and the like, according to various examples.

Figure 17:
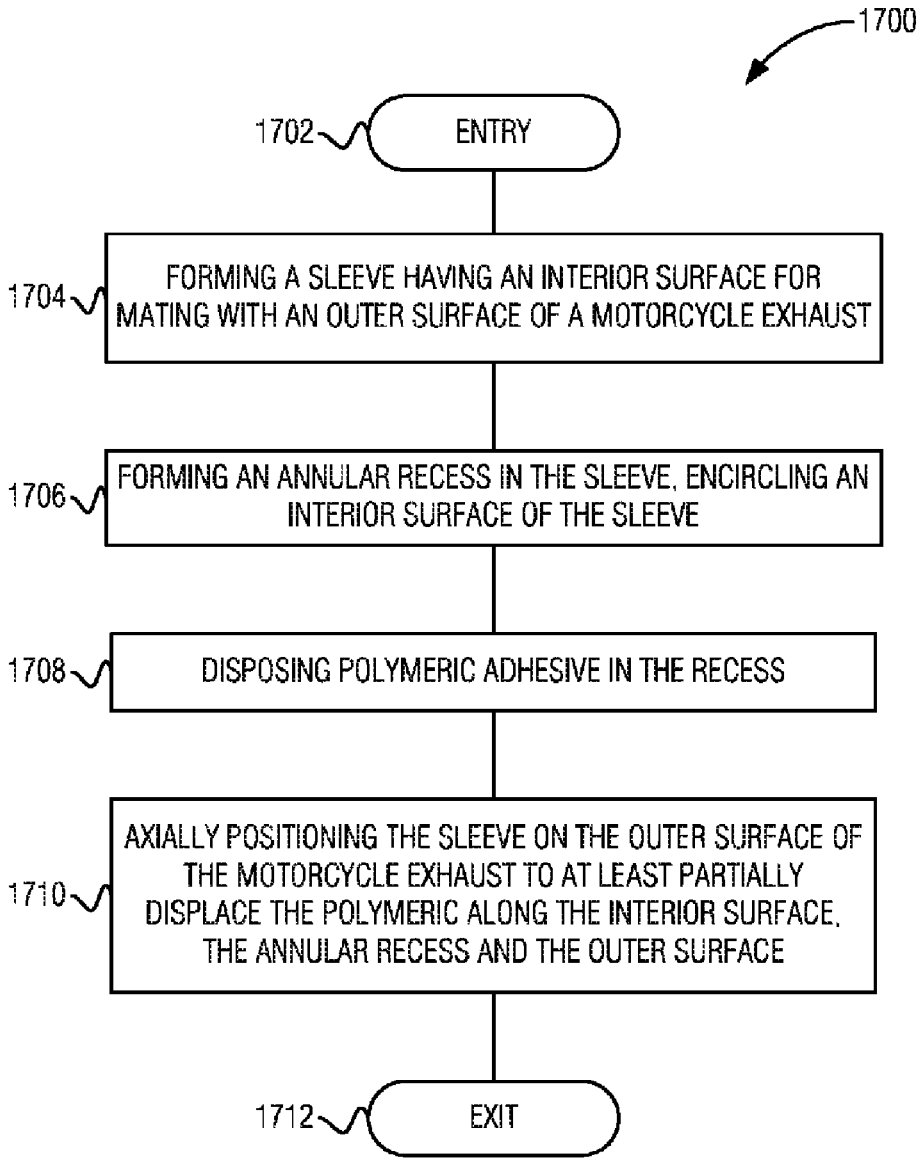
FIG. 17 is a method of decorating an end of a motorcycle exhaust system, according to some examples.

FIG. 17 is a method of decorating an end of a motorcycle exhaust system, according to some examples. Certain examples extend to the ornamental design for the end-cap as shown and described in FIGS. 10-16. At 1702, the method is entered. At 1704, the method includes forming a sleeve having an interior surface for mating with an outer surface of a motorcycle exhaust system. At 1706, the method includes forming an annular recess in the sleeve, encircling an interior surface of the sleeve. At 1708, the method includes disposing polymeric adhesive in the recess. At 1710, the method includes axially positioning the sleeve on the outer surface of the motorcycle exhaust system to at least partially displace the polymeric along the interior surface, the annular recess and the outer surface.

Optional systems and methods include removing any excess polymeric adhesive. Some examples are included wherein removing the excess polymeric adhesive includes excising the adhesive with a blade. Examples are included wherein removing the excess polymeric adhesive includes excising the adhesive with a handheld blade. In various examples, determinations of what is handheld are made by referencing a standard, such as an SAE or ASME standard. In some examples, a sleeve or end-cap is to be removably coupled to the exhaust system without chemically changing the exhaust system. Examples of chemical changes include heating, drilling, welding and like processes that alter grain structure permanently.

In this document, the terms "a" or "an" are used, as is common in patent documents, to include one or more than one, independent of any other instances or usages of "at least one" or "one or more." In this document, the term "or" is used to refer to a nonexclusive or, such that "A or B" includes "A but not B," "B but not A," and "A and B," unless otherwise indicated. In this document, the terms "including" and "in which" are used as the plain-English equivalents of the respective terms "comprising" and "wherein." Also, in the following claims, the terms "including" and "comprising" are open-ended, that is, a system, device, article, or process that includes elements in addition to those listed after such a term in a claim are still deemed to fall within the scope of that claim. Moreover, in the following claims, the terms "first," "second," and "third," etc. are used merely as labels, and are not intended to impose numerical requirements on their objects.

The above description is intended to be illustrative, and not restrictive. For example, the above-described examples (or one or more aspects thereof) may be used in combination with each other. Other embodiments can be used, such as by one of ordinary skill in the art upon reviewing the above description. The Abstract is provided to comply with 37 C.F.R. §1.72(b), to allow the reader to quickly ascertain the nature of the technical disclosure. It is submitted with the understanding that it will not be used to interpret or limit the scope or meaning of the claims. Also, in the above Detailed Description, various features may be grouped together to streamline the disclosure. This should not be interpreted as intending that an unclaimed disclosed feature is essential to any claim. Rather, inventive subject matter may lie in less than all features of a particular disclosed embodiment. Thus, the following claims are hereby incorporated into the Detailed Description, with each claim standing on its own as a separate embodiment, and it is contemplated that such embodiments can be combined with each other in various combinations or permutations. The scope of the invention should be determined with reference to the appended claims, along with the full scope of equivalents to which such claims are entitled.

What is claimed is:

1. An apparatus mountable to an exhaust system, the apparatus comprising:

an elongate sleeve including an annular leading edge defining a leading opening, and an annular trailing edge defining a trailing opening of a smaller diameter than the leading opening, with the leading opening in fluid communication with the trailing opening, the sleeve including:

an annular interior surface having a frusto-conical shape extending between the leading edge and the trailing edge, with the sleeve defining, an annular recess in the annular interior surface, the annular recess extending around the sleeve along a plane that is substantially parallel with the leading opening, the annular interior surface configured to mate with an exterior frusto-conical shape of an exterior surface of the exhaust system, and an outer surface with a decorative design other than an appearance of the exhaust system, wherein the sleeve is sized to dispose the annular recess along the exterior surface of the exhaust system in use; and a flexible polymeric adhesive disposed in the annular recess to affix the sleeve to the exterior surface of the exhaust system.

2. The apparatus of claim 1, wherein a distance between the leading edge and the trailing edge is selected to extend the trailing edge away from the exhaust system in use, with an exposed portion of the annular interior surface extending between the trailing edge and the exhaust system.

3. The apparatus of claim 1 wherein the flexible polymeric adhesive has a higher coefficient of thermal expansion than each of the exhaust system and the sleeve.

4. The apparatus of claim 3, wherein the sleeve is metallic and has a different coefficient of thermal expansion than the exhaust system, which is also metallic.

5. The apparatus of claim 1, wherein the annular recess is proximal the leading edge, closer to the leading edge than the trailing edge.

6. The apparatus of claim 1 wherein the sleeve is to be removably coupled to the exhaust system without chemically changing the exhaust system.

7. A system, comprising:

a passenger portion;

an engine coupled to the passenger portion to propel the passenger portion;

an exhaust system coupled to the engine to exhaust combustion gas away from the passenger portion, the exhaust system including an exhaust system having a distal exhaust exit portion having a frusto-conical shape;

an elongate sleeve including an annular leading edge defining a leading opening, and an annular trailing edge defining a trailing opening of a smaller diameter than the leading opening, with the leading opening in fluid communication with the trailing opening, the sleeve including:

an annular interior surface having a frusto-conical shape extending between the leading edge and the trailing edge, with the sleeve defining, an annular recess in the annular interior surface, the annular recess extending around the sleeve along a plane that is substantially parallel with the leading opening, the annular interior surface configured to mate with an exterior frusto-conical shape of an exterior surface of the exhaust system, and an outer surface with a decorative design other than an appearance of the exhaust system, wherein the sleeve is sized to dispose the annular recess along the exterior surface of the exhaust system in use; and a flexible polymeric adhesive disposed in the annular recess to affix the sleeve to the exterior surface of the exhaust system.

8. The system of claim 7 wherein the sleeve is to be removably coupled to the exhaust system without chemically changing the exhaust system.

9. The system of claim 7, wherein a distance between the leading edge and the trailing edge is selected to extend the trailing edge away from the distal exhaust exit portion in use, with an exposed portion of the annular interior surface extending between the trailing edge and the exhaust exit portion.

10. The system of claim 7 wherein the flexible polymeric adhesive has a higher coefficient of thermal expansion than each of the exhaust system and the sleeve.

11. The system of claim 10, wherein the sleeve has a different coefficient of thermal expansion than the exhaust system.

* * * * *